United States Patent [19]

Cha

[11] 4,279,302

[45] Jul. 21, 1981

[54] DETERMINING THE LOCUS OF A PROCESSING ZONE IN AN OIL SHALE RETORT BY EFFLUENT OFF GAS HEATING VALUE

[75] Inventor: Chang Y. Cha, Bakersfield, Calif.

[73] Assignee: Occidental Oil Shale, Inc., Grand Junction County, Calif.

[21] Appl. No.: 86,789

[22] Filed: Oct. 22, 1979

Related U.S. Application Data

[63] Continuation of Ser. No. 883,065, Mar. 3, 1978, abandoned.

[51] Int. Cl.[3] ..... E21B 43/247; E21B 47/00; E21C 41/10

[52] U.S. Cl. ..... 166/251; 166/254; 299/2

[58] Field of Search ..... 166/251, 259, 250; 299/2; 208/11 R

[56] References Cited

U.S. PATENT DOCUMENTS

| | | | |
|---|---|---|---|
| 3,454,365 | 7/1969 | Lumpkin et al. | 166/251 X |
| 3,467,189 | 9/1969 | Dingley | 166/251 |
| 3,736,247 | 5/1973 | Jones, Jr. et al. | 208/11 R |
| 3,994,343 | 11/1976 | Cha et al. | 166/259 |
| 4,025,416 | 5/1977 | Deering et al. | 208/11 R |
| 4,072,350 | 2/1978 | Bartel et al. | 299/2 |
| 4,082,145 | 4/1978 | Elkington | 166/251 |
| 4,150,722 | 4/1979 | Cha et al. | 166/251 |
| 4,162,706 | 7/1979 | Cha | 299/2 X |

OTHER PUBLICATIONS van Poollen, "Transient Tests Find Fire Front in an In Situ Combustion Project," *Oil and Gas Journal,* vol. 63, No. 5, Feb. 1, 1965, pp. 78–80.

Burwell et al., "Usable Gas from Oil Shale During Retorting," Bureau of Mines Oil Shale Program Technical Progress Report 85, Nov. 1974.

Lenhart, "TOSCO Process Shale Oil Yields," AIME 97th Annual Meeting, Feb. 27, 1968.

*Primary Examiner*—James A. Leppink
*Assistant Examiner*—George A. Suchfield
*Attorney, Agent, or Firm*—Arnold Grant

[57] ABSTRACT

A processing zone advances through a fragmented permeable mass of particles containing oil shale in an in situ oil shale retort in a subterranean formation containing oil shale. The retort has an effluent gas passing therefrom. The effluent gas has a heating value which is dependent on the kerogen content of the oil shale then in contact with the processing zone. To determine the locus of the processing zone, the formation is assayed at selected locations in the retort for kerogen content before processing the selected locations, and effluent gas from the retort is monitored for its heating value.

14 Claims, 2 Drawing Figures

Figure 1:
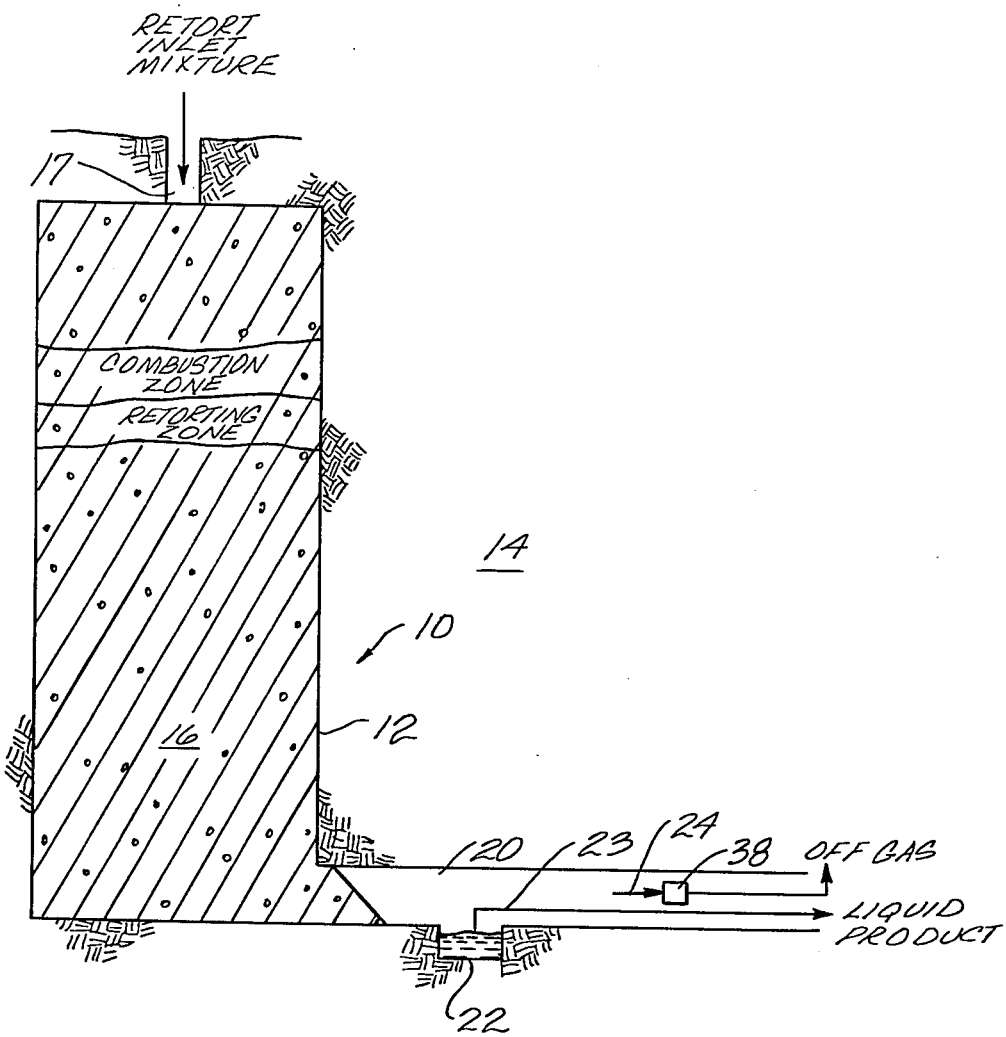

DETERMINING THE LOCUS OF A PROCESSING ZONE IN AN OIL SHALE RETORT BY EFFLUENT OFF GAS HEATING VALUE

This is a continuation of application Ser. No. 883,065, filed Mar. 3, 1978, now abandoned.

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "Shale Oil".

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and continued introduction of an oxygen containing retort inlet mixture into the retort to advance the combustion zone through the retort. As used herein the term "combustion zone" is used to indicate that zone in the retort in which the oxygen in the oxygen containing retort inlet mixture is depleted by reaction with hot carbonaceous materials to produce heat and combustion gas. The combustion zone is maintained at a temperature lower than the fusion temperature of oil shale, which is about 2100° F., to avoid plugging of the retort, and above about 1100° F., for efficient recovery of hydrocarbon products from the oil shale.

The effluent gas from the combustion zone, which is essentially free of free oxygen and comprises hydrogen, carbon-monoxide, carbon dioxide, and such hydrocarbons as methane, ethane, ethene, propane, propene, butane, isobutane, butene-1 cis and trans-2-butene, pentane, isopentane, hexane and heptane, advances through the retort to the retorting zone. As used herein the term "retorting zone" refers to that portion of the retort on the advancing side of the combustion zone wherein the effluent gas from the combustion zone heats the oil shale to a temperature sufficient to produce kerogen decomposition, called retorting, in the oil shale to gaseous and liquid products and to a residue of solid carbonaceous materials.

The term "processing zone" refers herein to either a combustion zone, a retorting zone, or both a retorting zone and combustion zone, in an in situ oil shale retort; and, the term "processing gas" is used to indicate a gas which serves to advance a processing zone and includes, but is not limited to, an oxygen supplying gas introduced into a retort for advancing a combustion zone and retorting zone through a retort and a hot retorting gas which can be introduced into a retort or generated in a combustion zone in a retort for advancing a retorting zone through a retort.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft where they are separated. An effluent gas, referred to herein as off gas, and any gaseous portion of the combustion zone feed that does not take part in the combustion process is also withdrawn from the bottom of the retort.

There are several reasons why it is necessary to know the locus of parts of the combustion and retorting zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason to monitor the locus of the combustion zone is to provide information so the composition of the combustion zone feed can be varied with variations in the kerogen content of oil shale being retorted. Formations containing oil shale include horizontal strata or beds of varying kerogen content. If the concentration of oxygen introduced into a region of the retort is too high for the kerogen content in that region, oxidation of carbonaceous material in the oil shale can generate so much heat that fusion of the oil shale will result, thereby producing a region of the fragmented mass which cannot be penetrated by retorting gases.

Another reason for monitoring the locus of the combustion and retorting processing zones as they advance through the retort, is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting zones through an in situ oil shale retort.

SUMMARY OF THE INVENTION

The present invention concerns a process for determining the locus of a retorting and/or combustion zone as it advances through a fragmented permeable mass of particles containing oil shale in a retort formed in a subterranean formation containing oil shale. More particularly, the present invention is an application of the principle that the heating value of the effluent off gas generated by the processing zone as it passes through a particular level of the retort is a function of the kerogen content in that level, the richer the kerogen content, the higher will be the heating value of the effluent off gas. The present invention thus comprises the steps of determining, prior to retorting, the kerogen content at various levels in the subterranean formation, determining the heating value of the effluent off gas that will be generated by each level as the processing zone passes through that level, and, then analyzing the effluent off gas from the formation during retorting for its heating value.

DRAWINGS

Figure 2:
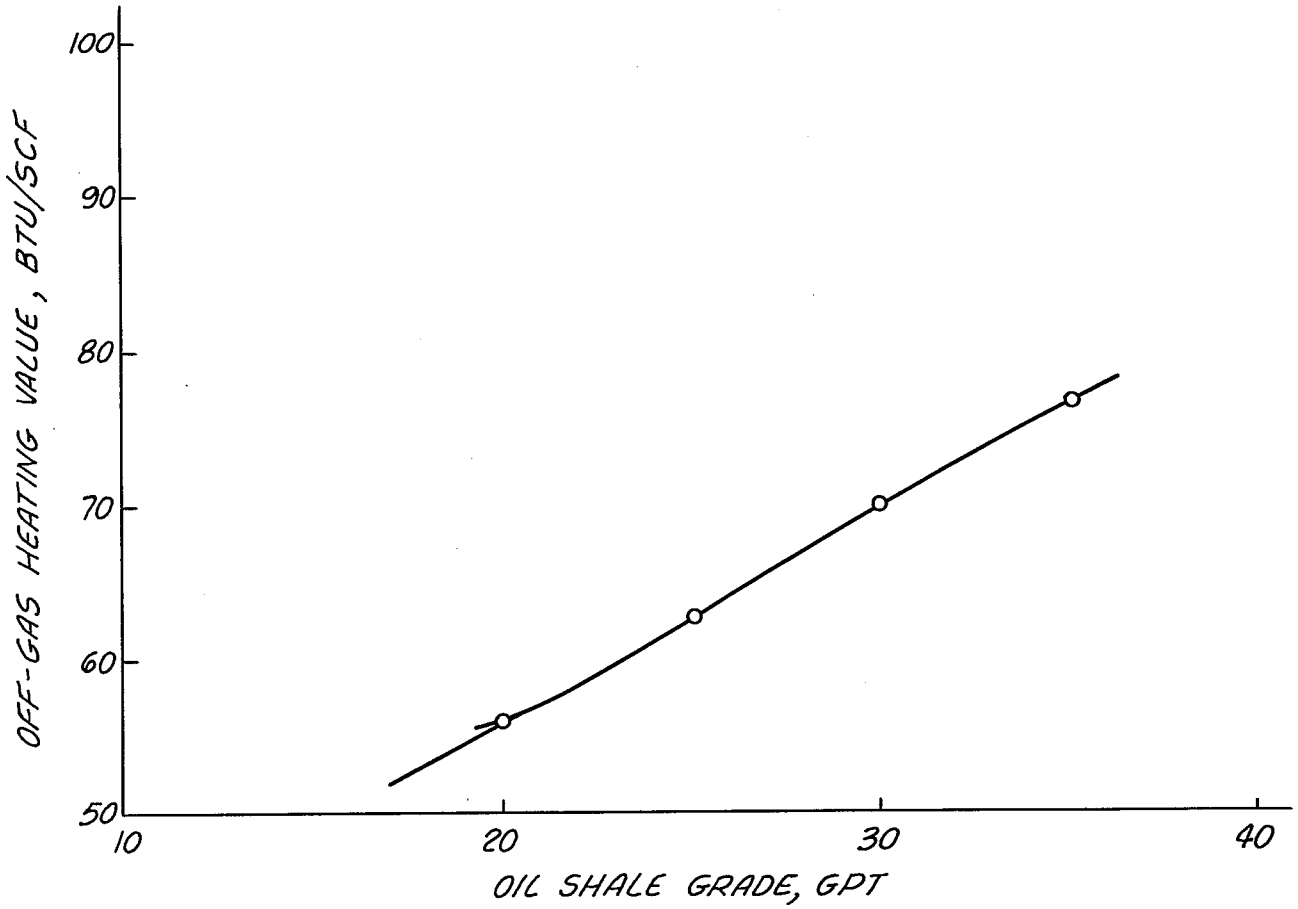

These and other features, aspects and advantages of the present invention will become more apparent upon consideration of the following description, appended claims, and accompanying drawings wherein:

FIG. 1 represents schematically in vertical cross section an in situ oil shale retort; and, FIG. 2 is a graph showing the direct correlation between oil shale kerogen content and heating value of the effluent gas that will be generated by processing of that oil shale.

DESCRIPTION

Referring to FIG. 1 an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles, such as by blasting by using any of a variety of known techniques. Alternatively, the cavity can be formed by excavating or mining a void within the boundaries of a subterranean in situ oil shale retort site and then explosively expanding the remaining oil shale in the formation toward the void. Methods of forming an in situ oil shale retort are described in U.S. Pat. Nos. 3,661,423, 4,043,595, 4,043,596, 4,043,597, and 4,043,598; a variety of other techniques can also be used.

A conduit 17 communicates with the top of the fragmented mass of formation particles. During the retorting operation, a combustion zone is established in the retort 10 by ignition of carbonaceous material in the oil shale. The combustion zone is advanced through the fragmented mass by introducing an oxygen containing retort inlet mixture into the in situ oil shale retort through the conduit 17 as a combustion zone feed. The retort inlet mixture can be air, or air enriched with oxygen, or air diluted by a fluid such as water, steam, a fuel, recycled off gas, an inert gas such as nitrogen, and combinations thereof.

Oxygen introduced to the retort in the retort inlet mixture oxidizes carbonaceous material in the oil shale to produce combustion gas, which, along with any unreacted portion of the combustion zone feed passes through the fragmented mass of particles on the advancing side of the combustion zone to establish a retorting zone on the advancing side of the combustion zone. Kerogen in the oil shale is retorted in the retorting zone to produce liquid and gaseous products.

There is an access tunnel, adit or drift 20 in communication with the bottom of the retort which contains a sump 22 for collection of the liquid products 23, including liquid hydrocarbon products and water.

An effluent off gas 24 comprising hydrogen, carbon monoxide, carbon dioxide from carbonate decomposition, and such hydrocarbons as methane, ethane, ethene, propane, propene, butane, butene-1, isobutane, cis and trans-2-butene, pentane, isopentane, hexane and heptane is also withdrawn from the in situ oil shale retort 10 by way of the drift 20. The liquid products and off gas are withdrawn from the retort as effluent fluids.

Oil shale typically is horizontally beded due to its sedimentary nature. Layers in the fragmented mass are correlated with strata in the unfragmented formation because there is little vertical mixing between strata even when they have been explosively fragmenting. Therefore, samples of various strata through the retort can be taken before initiating retorting of the oil shale and assays can be conducted to determine the kerogen content of each strata. Such samples can be taken either from within the fragmented mass in the retort site before expansion, or from the formation nearby the fragmented mass since little change in the kerogen content of oil shale or the constituents of the kerogen occurs over large areas of formation.

As shown in FIG. 2 the kerogen content of a sample of oil shale expressed as the gallons of shale oil per ton of oil shale is directly related to the Btu's per standard cubic foot contained in the effluent off gas that will be generated during the processing of the oil shale. The kerogen content assays can then be converted to predicted effluent off gas heating value and a profile of the retort can be prepared.

The locus of the retorting and/or combustion zones can be determined by analyzing the effluent off gas from the fragmented mass during retorting for its heating value and correlating the acutal heating value with the predicted heating values for the various levels in the retort. Monitoring means such as a calorimeter 38 can be provided for monitoring the effluent off gas after it has been separated from the shale oil. Other suitable monitoring means are well known in the art, such as gas chromatograph.

By way of review there are four steps to determine the elevation of a process zone in an in situ oil shale retort. First, the formation is assayed at selected elevations for kerogen content; at least two and preferably more elevations should be sampled to give meaning to the resultant data. Then, using a correlation between the kerogen content of the oil shale and the heating value or BTU per standard cubic foot that will be produced by processing that oil shale, the heating value for that level is predicted. Third, the actual heating value of the effluent off gas is determined. Finally, the predicted heating value and the actual heating value of the effluent off gas are compared. Thus, by knowing the kerogen content in the fragmented mass 16 at selected elevations, by knowing the correlation between kerogen and heating content value, and by knowing the actual heating value of the effluent off gas, the elevation of a processing zone in the retort can be determined.

Although this invention has been described in detail with reference to certain versions thereof, other versions of this invention can be practiced. Therefore, the spirit and scope of the appended claims should not be limited to the description of the preferred versions contained herein.

What is claimed is:

1. A method for determining the locus of a processing zone advancing through a fragmented permeable mass of particles containing oil shale in an in situ oil shale retort in a subterranean formation containing oil shale, the retort having an upper, a lower and side boundaries of unfragmented formation and the retort having an effluent off gas passing therefrom, the method comprising the steps of:

determining the kerogen content at selected locations in the subterranean formation intermediate the upper and lower boundaries of the retort before processing the retort; and monitoring the effluent off gas from the retort for its heating value.

2. The method of claim 1 wherein the processing zone is a retorting zone.

3. The method of claim 1 wherein the step of determining comprises assaying subterranean formation containing oil shale which is outside the side boundaries of the retort.

4. The method of claim 1 wherein the step of determining comprises assaying formation which is within the boundaries of the retort.

5. A method for determining the locus of a processing zone advancing through a fragmented permeable mass of particles containing oil shale in an in situ oil shale retort in a subterranean formation containing oil shale, the retort having an upper, a lower and side boundaries of unfragmented formation, the oil shale containing kerogen, the retort having an effluent off gas passing therefrom formed from kerogen in the oil shale, the method comprising the steps of:

determining kerogen content in formation at selected locations intermediate the upper and lower boundaries of the retort before processing the retort; and monitoring effluent off gas from the retort for its heating value.

6. The method of claim 5 wherein the processing zone is a retorting zone.

7. The method of claim 5 wherein the step of determining comprises assaying subterranean formation containing oil shale which is outside the side boundaries of the retort.

8. The method of claim 5 wherein the step of determining comprises assaying formation which is within the boundaries of the retort.

9. A method for determining the locus of a processing zone advancing through a fragmented permeable mass of particles containing oil shale in an in situ oil shale retort in a subterranean formation containing oil shale, said retort having an effluent off gas withdrawn therefrom, and said subterranean formation including a plurality of generally horizontal strata having different kerogen contents, the method comprising the steps of:

forming an in situ oil shale retort containing a fragmented permeable mass of formation particles containing oil shale in the formation, the fragmented mass containing generally horizontal layers of particles correlated with such strata;

assaying the formation at selected elevations for kerogen content in the fragmented mass;

predicting effluent off gas heating value at selected elevations in the fragmented mass;

establishing a processing zone in the fragmented mass;

introducing a processing gas to an upper portion of the fragmented mass for advancing the processing zone downwardly through the fragmented mass and for retorting oil shale in the fragmented mass with generation of the selected constituent from the selected precursor;

withdrawing effluent off gas from a lower portion of the retort;

determining the heating value of the effluent off gas from the retort; and comparing such a determined heating value from the retort with such a predicted heating value.

10. A method for determining the locus of a processing zone advancing downwardly through a fragmented permeable mass of particles containing oil shale in an in situ oil shale retort in a subterranean formation containing oil shale, said subterranean formation including a plurality of generally horizontal strata having different kerogen contents comprising the steps of:

forming an in situ oil shale retort containing a fragmented permeable mass of formation particles containing oil shale in the formation, the fragmented mass containing generally horizontal layers of particles correlated with such strata;

assaying kerogen content in layers in the fragmented mass at selected elevations;

predicting the heating value of the effluent off gas generated from the processing of the kerogen content in layers in the fragmented mass;

establishing a processing zone in the fragmented mass;

introducing a processing gas to an upper portion of the fragmented mass for advancing the processing zone downwardly through the fragmented mass and for retorting oil shale therein;

withdrawing effluent off gas from a lower portion of the fragmented mass;

monitoring effluent off gas from the fragmented mass for its heating value;

determining the heating value of the effluent off gas from the retort;

comparing such a determined heating value from the retort with such a predicted heating value.

11. A method for determining the locus of a processing zone advancing through a fragmented permeable mass of particles containing oil shale in an in situ oil shale retort in a subterranean formation containing oil shale, the retort having an upper, a lower and side boundaries of unfragmented formation and the retort having an effluent gas passing therefrom, such effluent gas having a heating value which is a function of the kerogen content of the oil shale in the retort being processed by the processing zone, the method comprising the steps of:

determining the kerogen content of the oil shale at selected locations in the subterranean formation intermediate the upper and lower boundaries of the retort before processing the retort;

predicting the heating value of the effluent gas from the retort due to processing the fragmented permeable mass of particles containing oil shale in the retort;

monitoring the effluent off gas from the retort for its heating value; and correlating the heating value of the effluent off gas with such predicted heating values for determining the locus of the processing zone in the retort.

12. The method of claim 11 wherein the processing zone is a retorting zone.

13. The method of claim 11 wherein the step of determining comprises assaying subterranean formation containing oil shale which is outside the side boundaries of the retort.

14. The method of claim 11 wherein the step of determining comprises assaying subterranean formation which is within the boundaries of the retort.

* * * * *